US010735881B2

(12) United States Patent
Young et al.

(10) Patent No.: US 10,735,881 B2
(45) Date of Patent: Aug. 4, 2020

(54) METHOD AND APPARATUS FOR AUDIO TRANSFER WHEN PUTTING ON/REMOVING HEADPHONES PLUS COMMUNICATION BETWEEN DEVICES

(71) Applicant: Sony Corporation, Tokyo (JP)

(72) Inventors: David Young, San Diego, CA (US); Hyehoon Yi, San Diego, CA (US)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/155,778

(22) Filed: Oct. 9, 2018

(65) Prior Publication Data

US 2020/0112810 A1 Apr. 9, 2020

(51) Int. Cl.

| | |
|---|---|
| ***H04R 5/02*** | (2006.01) |
| ***H04S 1/00*** | (2006.01) |
| ***H04S 7/00*** | (2006.01) |
| ***H04R 5/033*** | (2006.01) |
| *H04R 1/10* | (2006.01) |

(52) U.S. Cl.

CPC ..... *H04S 1/005* (2013.01); *H04R 5/033* (2013.01); *H04S 7/304* (2013.01); *H04S 2400/01* (2013.01)

(58) Field of Classification Search

CPC ..... H04S 1/005; H04S 2400/01; H04S 7/304; H04R 5/033

USPC ..... 381/74, 303

See application file for complete search history.

(56) References Cited

U.S. PATENT DOCUMENTS

| | | | | |
|---|---|---|---|---|
| 8,098,838 | B2 | 1/2012 | Lee et al. | |
| 9,232,335 | B2 | 1/2016 | Carlsson et al. | |
| 2008/0181435 | A1* | 7/2008 | Ozaki | H03G 3/348 381/107 |
| 2011/0196519 | A1 | 8/2011 | Khoury et al. | |
| 2012/0244812 | A1* | 9/2012 | Rosener | H04M 1/05 455/41.3 |
| 2017/0280223 | A1 | 9/2017 | Cavarra et al. | |
| 2019/0082371 | A1* | 3/2019 | Burt | H04W 36/36 |

OTHER PUBLICATIONS

SweepSense: AdHoc Configuration Sensing Using Reflected Swept-Frequency Ultrasonics; http://www.gierad.com/assets/sweepsense/sweepsense.pdf; Gierad Laput Xiang 'Anthony' Chen Chris Harrison Human-Computer Interaction Institute—4 pages.

* cited by examiner

*Primary Examiner* — Ammar T Hamid

(74) *Attorney, Agent, or Firm* — Trellis IP Law Group, PC

(57) ABSTRACT

An entertainment system includes an audio transmission device, for example a digital television. configured to provide audio signals over multiple channels. The entertainment system also includes an audio receiving device, for example over-the-ear or wireless headphones, configured to receive signals from the audio transmission device. The audio receiving device includes a sensor. When the sensor is in a first position the audio receiving device receives the signals from the audio transmission device. Correspondingly, when the sensor is in a second position, the audio receiving device does not receive the signals from the audio transmission device.

16 Claims, 4 Drawing Sheets

300

METHOD AND APPARATUS FOR AUDIO TRANSFER WHEN PUTTING ON/REMOVING HEADPHONES PLUS COMMUNICATION BETWEEN DEVICES

FIELD OF THE INVENTION

The present invention generally relates to entertainment systems and, more particularly, to transmitting audio signals to one or more components within the entertainment system.

BACKGROUND

When watching television or listening to music, users must be cognizant of disturbing other people. For example, if you are watching television or listening to a stereo in a public area, for example, a recreation or break room the volume of the television or stereo may interfere with someone else in the room who may be reading a book or trying to have a conversation with another person in the room. Conventionally, you may mitigate this problem by connecting a headset or pair of headphones directly to the television. A drawback with such a solution is that the user must get up and manually connect the listening devices to the television. Depending on the length of the connection mechanism, the user may have to be too close to the television, for example, to enjoy the video content of the program they are watching.

Another drawback with having to manually connect listening devices to audio sources is that if the user moves to another room, the user must manually connect the listening devices to the components in the other room. An affiliated drawback with manual device connection is the possibility that the connectors of the audio source and listening devices are not compatible. This results in an unsatisfactory user experience.

SUMMARY

An entertainment system includes an audio transmission device, for example a digital television. configured to provide audio signals over multiple channels. The entertainment system also includes an audio receiving device, for example over-the-ear or wireless headphones, configured to receive signals from the audio transmission device. The audio receiving device includes a sensor. When the sensor is in a first position the audio receiving device receives the signals from the audio transmission device. Correspondingly, when the sensor is in a second position, the audio receiving device does not receive the signals from the audio transmission device.

The audio transmission and audio receiving devices may be coupled via a network or through near field communication protocols. When the audio receiving device and the audio transmission device are coupled, the audio signals are received by the audio receiving device. When the audio transmission and audio receiving devices are not couple, the audio signals are transmitted via the output devices, for example, of the audio transmission device.

When the user moves from one room or area to another room or area, the connection to the audio transmission device in the prior is returned by the speakers of that particular device; the audio receiving device couples to an audio transmission device in the subsequent room and any audio being provided by the speakers or other audio transmitters components of the audio transmission device cease and the audio signals are transmitted to the newly coupled audio receiving device.

A feature provided by the present invention is that audio transmission and audio receiving devices may be coupled on the fly via a network hub.

Another feature provided by the present invention is that communication between the audio devices may be provided by a microphone incorporated in the audio receiving devices.

A benefit provided by the present invention is that through the use of the audio receiving devices, other persons in local proximity to the audio transmission device may not be disturbed or otherwise distracted by the audio being provided by the audio transmission device.

A further understanding of the nature and the advantages of particular embodiments disclosed herein may be realized by reference of the remaining portions of the specification and the attached drawings.

DETAILED DESCRIPTION OF EMBODIMENTS

Figure 1:
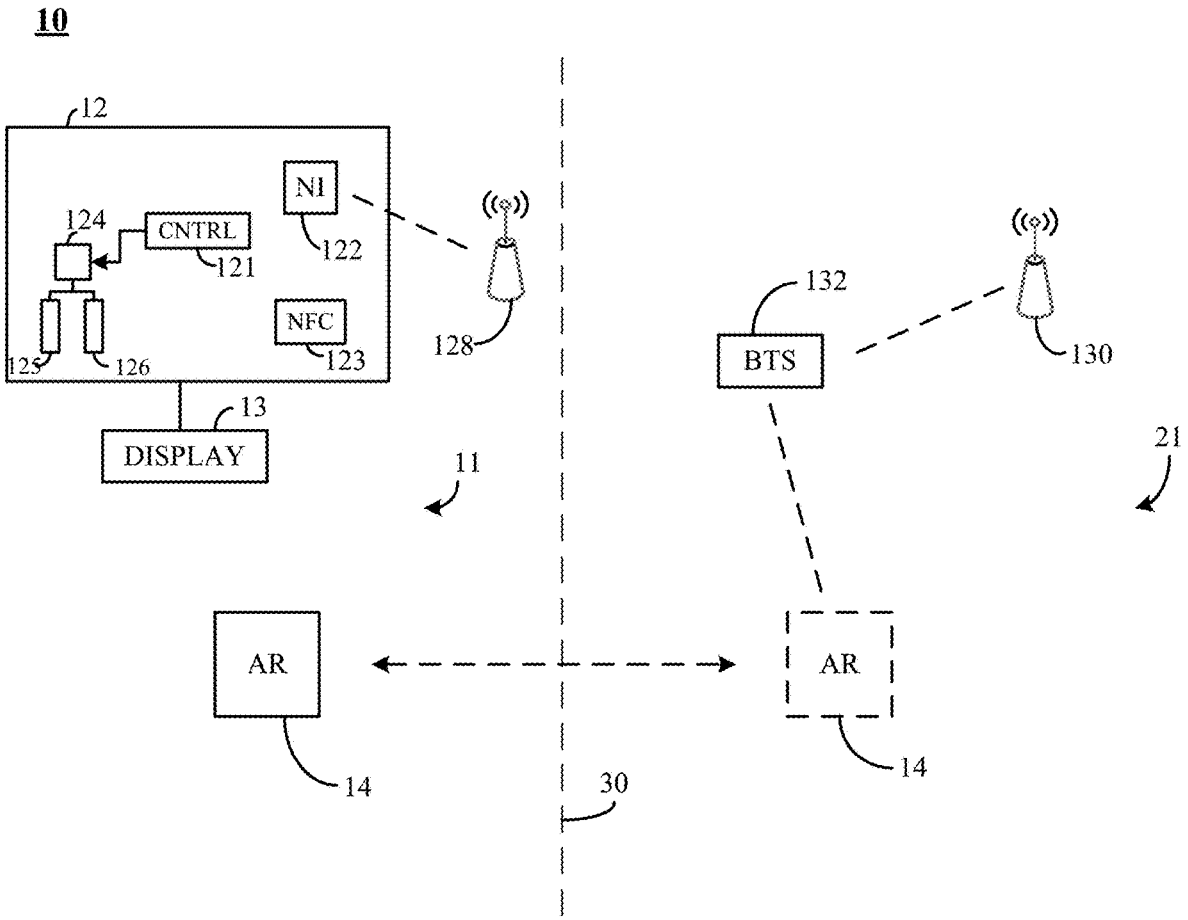
FIG. 1 is a schematic block diagram of an entertainment system incorporating the audio transmission and receipt functionality according to the present invention.

An exemplary embodiment of the present invention will now be described with reference to FIGS. 1-4. FIG. 1 is a schematic block diagram of an entertainment system 10, incorporating the audio transmission and receipt functionality according to the present invention. The entertainment system may be provided within and/or between two rooms 11, 21 within a structure separated by a wall or divider 30. Each room 11, 21 has a dedicated network hub or wireless access point 128. 130 for enabling or otherwise provide a local area network within the applicable range of the network hubs 128, 130. In an alternate embodiment of the present invention, a single access point or network hub may be used to interconnect the plurality of devices that are connected to the network.

The entertainment system 10 includes an audio transmission device 12, an audio receiving device 14, a first network hub or access point 128, speakers (e.g. Bluetooth Speakers) 132 and a second network hub or access point 130. The audio transmission device 12, may be implemented as a digital television, a laptop computer, a desktop computer, a tablet device, a personal digital assistant or any suitable device capable of providing audio and video content to a user.

In an exemplary embodiment, the audio transmission device is implemented as a digital television 12, including a controller 121, a network connection 122, a near field communication connection module 123, an audio controller 124, speakers 125, 126 for providing audio content to a user and a display 13 device.

The controller 121 may be implemented as a processor, a controller, a microcontroller, an integrated circuit or any suitable device configured and capable of controlling the functionality and operation of the television.

The network interface module 122 may be implemented by any suitable device capable of connecting the television 12 to a corresponding network. For example, the network interface module may be an 802.11n connection, a USB connection or any suitable connection or module. The network interface module 122 may receive signals from the audio receiving device 14 to establish a connection in certain embodiments.

The near field communication module 123 may be implemented by any device capable of providing a near field communication link between the television 12, for example, and the audio receiving device 14.

The audio controller 124 may be implemented by any device capable of controlling one or more speakers 125, 126 that may be integrated within the television 12 or otherwise externally coupled to the television 12, for example a sound bar. Depending on the signal received from the audio receiving device 14, the audio controller 124 will cause any audio signals to be transmitted by the television speakers 125, 126 or transmit the audio signals to the audio receiving device 14 as will be explained in greater detail below.

The display 13 may be implemented by any suitable device, for example, LED, LCD, OLED, touch screen for presenting visual information to a user. Although illustrated as being separate from the body of the television 12, the display 13 may be integrated within the body of the television 12.

The audio receiver 14 may be implemented by wireless speakers, ear buds, over-the-ear speakers or any suitable device capable of receiving audio transmissions and providing sound to a user. In an exemplary embodiment, the audio receiver 14 is implemented by wireless speakers. The architecture and functionality of the audio receiver 14 is described in greater detail with respect to FIGS. 2 and 4.

The stand-a-lone speakers 132 may be implemented by any suitable device capable of providing audio signals to a user. In an exemplary embodiment of the present invention, the speakers 132 are implemented by Bluetooth speakers. The Bluetooth speakers 132 connect to a corresponding network via a network hub or access point 130.

The network hubs or access points 128, 130 may be implemented by any suitable device capable of establishing a local area network, for example, an 802.11n hub, server, a distributed network or a small field network.

In an exemplary embodiment, the television 12 is coupled to a local area network via network hub 128; the audio receiving device, for example, wireless headphones 14 is also connected to the local area network configured by network hub 128. Audio content is initially provided by the television speakers 125, 126 under control of the audio controller 124. When the wireless speakers 14 connect to the network or the wireless speakers sends a signal, for example, when the user puts on the headphones, via sensor module 142 (FIG. 2), to the audio controller 124, the audio transmission is removed or otherwise disconnected from the speakers 125, 126 and sent to the wireless speakers 14. In this manner, audio transfer is seamlessly performed without a loss of fidelity or interruption of others who may be in the room. For example, if there are two or more people in a room with a television playing in the background, they may be interrupted by the audio volume. With the present invention, television audio is automatically transferred to connected earphones; noise interruptions or other inconveniences experienced by others in the same or a nearby room are greatly mitigated.

In addition to being able to receive audio signals within a first room 11, a user can move from one room to another, the headphones (e.g. audio receiving device 14) automatically connect to a different network via a second network hub 130 in a second room (as shown in dashed outline) 21 and receive audio transmissions from an audio transmission device, for example, Bluetooth speakers 132 connected to the second network. When leaving the first room 11, the connection with the television 12 is terminated. When entering the second room 21 a connection with the speakers 132 is established either via the second network or near field communication connection; thereby initiating transmission from the speaker 132 to the headphones 14. Again, the transition will be seamless, therefore maintaining the fidelity of the audio reception without disturbing others in the second room 21.

Figure 2:
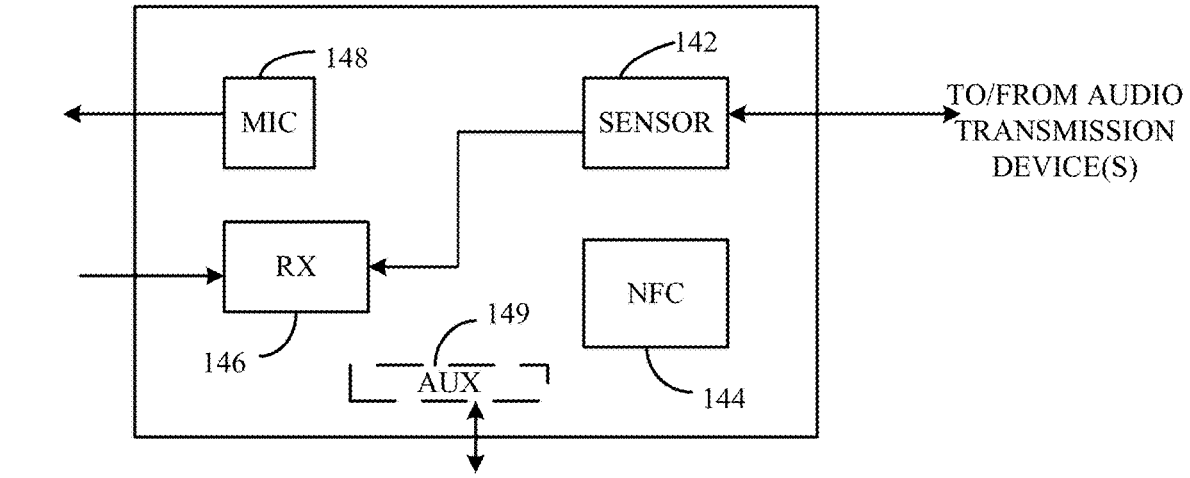
FIG. 2 is a schematic block diagram of the audio receiving device according to the present invention.

FIG. 2 is a schematic block diagram of the audio receiving device 14 according to an exemplary embodiment of the present invention. The audio receiving device 14 may be implemented by over-the-ear headphones, wired headphones or wireless headphones. In an exemplary embodiment, the audio receiving device is implemented as wireless headphones.

The wireless headphones 14 include a sensor module 142, a near field communication module 144, a receiver 146, a microphone 148 and an auxiliary module 149. The sensor module 142 may be implemented by any suitable switch or component that has a first (e.g. off) position and a second (e.g. on) position. The switch may be translated to a first position when the user puts the headphones on or places earbuds within the ear. The switch may be translated into a second position, when the headphones or earbuds are removed from the user. In addition to engaging in on/off positioning, the sensor module 142 is also configured to connect the wireless headphones 14 to a corresponding network. In this manner, the wireless headphones 14 may be interconnected with other components, for example, the digital television 12 (FIG. 1) via wireless access point or hub 128 (FIG. 1). When the sensor module 142 switch is in the first (or on) position, the headphones connect with a corresponding audio transmitting device and receive the audio signals therefrom. On the other hand, when the sensor module 142 switch is in the second (or off) position, which occurs when the headphones are removed from the user, the headphones are disconnected from the audio transmission device and audio signals are no longer received by the headphones.

The near field communication module 144 may be implemented by any suitable device capable of providing a near field communication (NFC) link between the wireless headphones 14 and a corresponding transmission device (e.g. television 12 (FIG. 1) within the near field proximity of the headphones 14. In an alternate embodiment of the present invention, when an NFC link is established, the audio signals from the audio transmission device are received by (e.g. transmitted to) the wireless headphones 14 in lieu of the speakers or other audio transmission means associated with the audio transmission device.

The receiver 146 may be implemented by any suitable device capable of receiving an audio signal. The audio signal may be either an analog or a digital signal. Alternatively, the receiver 146 may be implemented by an analog-to-digital or a digital-to-analog converter which would enable the user of the headphones to receive and listen to broadcasting, music, soundtracks from a corresponding transmitting device independent of format.

The microphone 148 may be implemented by any suitable device or component capable of transmitting voice signals or commands to one or more receiving devices. For example, in an embodiment where two or more users are using wireless headphones, a first user may talk to a second user through the microphone 148 without negatively affecting a third user. More specifically, the users with headphones can communicate with one another without interfering with a third user that is in proximate location of the first and second user.

The auxiliary module 149 may be, for example, a connection port for a power adapter used to charge the headphones 14, for example, if the headphones are wireless or a connection port used to connect the headphones to an associated unit to receive audio signals, for example, a base station or larger receiver if the headphones are wired devices.

Figure 3:
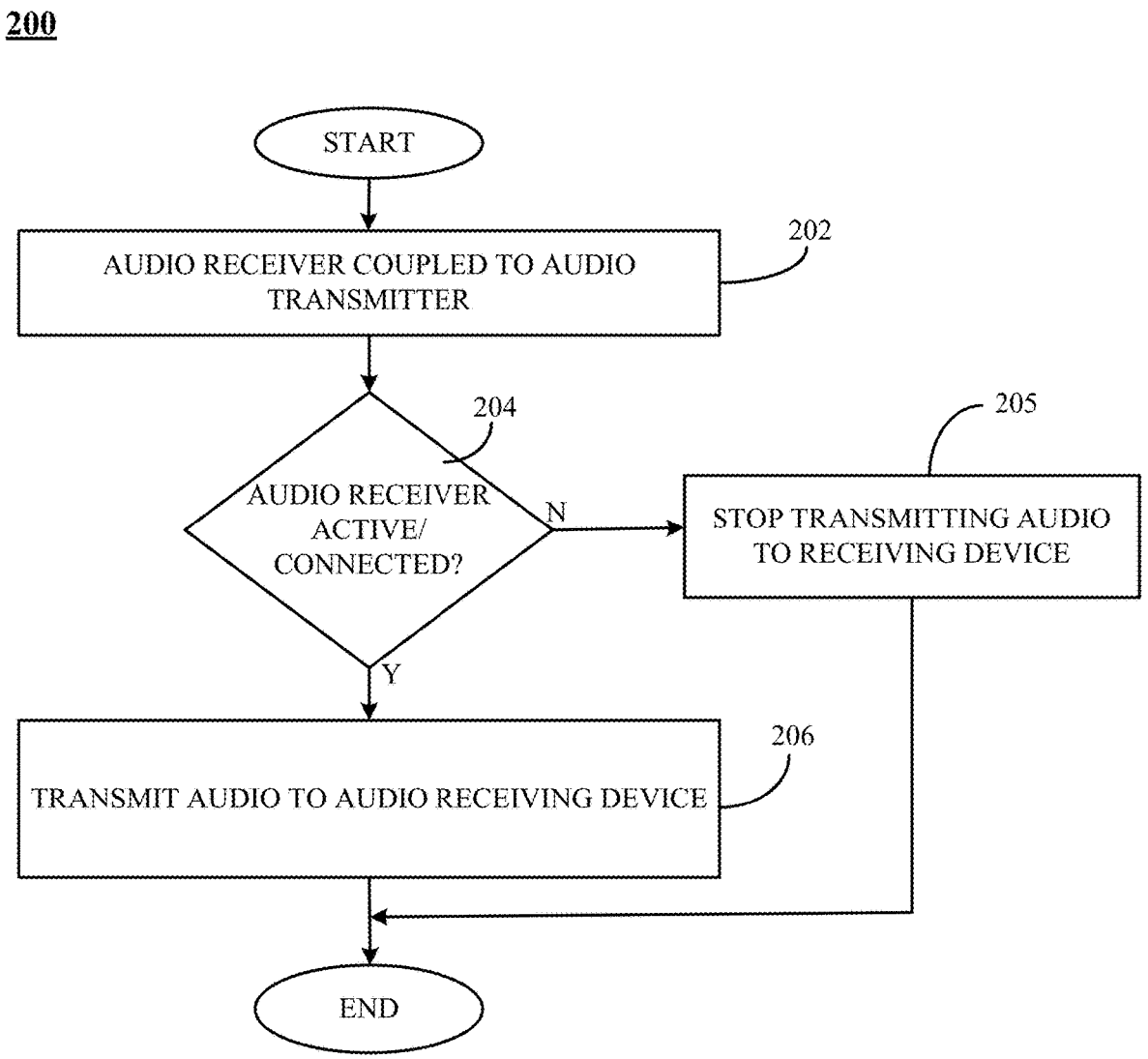
FIG. 3 is a flow chart of the steps performed by the entertainment system when transmitting audio signals to the audio receiving device according to the present invention.

FIG. 3 is a flow chart 200 of the steps performed by the entertainment system when transmitting audio signals to the audio receiving device according to the present invention. The process begins at step 202 where the audio receiver is coupled to the audio transmitter. This may be accomplished, for example, by the headphones 14 (FIG. 1) being coupled to the television 12 (FIG. 1) via the network hub 128 (FIG. 1). Alternatively, this may be accomplished, for example, by establishing a near field connection between the headphones 14 (FIG. 1) and the television 12 (FIG. 1) when the headphones are in close proximity to the television.

In step 204 a determination is made as to whether the audio receiver is active or connected to an audio transmitting device. This may be accomplished, for example, by determining whether the sensor of the headphones is in the on position and transmitting a connection or transmit signal to the network interface module 122 (FIG. 1) of the television, or alternatively, a near field connection is currently established between the headphones and the television. If the connection is not active, for example, the sensor switch of the headphones is in the off position, the process moves to step 205 where audio transmission to the headphones is stopped. In this manner, the audio signals for any content being played by or on the television are provided or otherwise transmitted by the speakers 125, 126 (FIG. 1).

If it is determined that the audio receiver connection is active, the process moves to step 206 where the audio is transmitted to the headphones via the audio controller 124 (FIG. 1). In this manner, when the audio transmission device, for example, the television and the audio receiving device, for example, the headphones are connected, the audio is transmitted to the headphones. Consequently, other people who are in the room or close proximity of the audio transmission device are not disturbed or otherwise interrupted by the content being played on the audio transmission device as the audio is not being played by the speakers. In similar fashion, when the user moves from one room to another room, the headphones are then connected to the network of the second room by joining the network controller by an appropriate network hub 130 (FIG. 1) in the second. When the second room network connection is made, audio transmission from the television is discontinued; thereby, causing the audio to be transmitted via the corresponding television speakers and the headphones will begin to receive the audio from the audio transmission device in the second room, for example, Bluetooth the speakers 132 (FIG. 1). The process then ends. In this manner, a user may move from and/or between rooms and receive audio transmissions without interruption or disturbing any occupants of the rooms.

Figure 4:
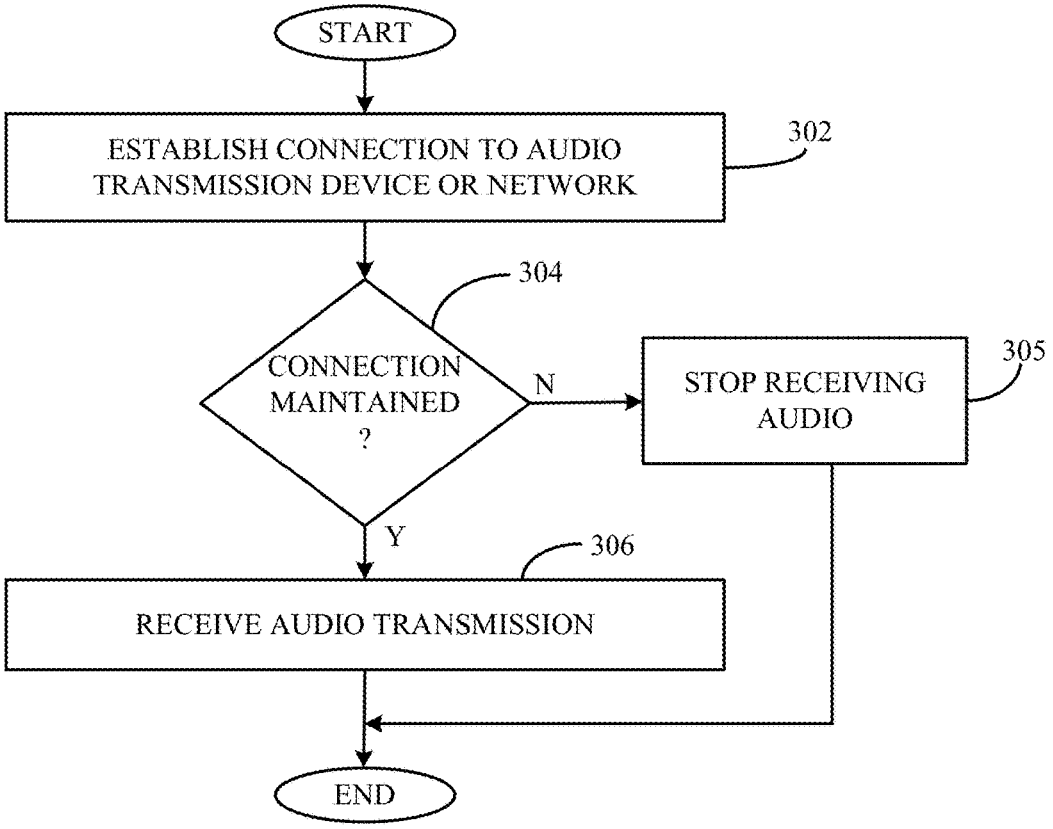
FIG. 4 is a flow chart of the steps performed by the audio receiving device to provide for audio transmission receipt according to the present invention.

FIG. 4 is a flow chart of the steps performed by the audio receiving device, for example, headphones 14 (FIG. 2) to provide for audio transmission receipt according to the present invention. The process begins at step 302 where a connection is established with the audio transmission device or corresponding network. This may be accomplished, for example, by the sensor module 142 (FIG. 2) connecting the headphones with the corresponding network or establishing a near field communication link between the headphones and a corresponding audio transmission device, for example, a television 12 (FIG. 1) or speakers 132 (FIG. 2). The connection may be via the local area network or a Bluetooth connection. The process proceeds to step 304.

In step 304 a determination is made as to whether the connection is maintained. This may be accomplished, for example, determining whether the sensor switch is in an on (e.g. first) or off (e.g. second) position. Alternatively, a determination is made as to whether the near field connection link is maintained or active. If the switch is in the off (e.g. second) position or the near field connection is no longer established or active, the process proceeds to step 305. If the switch is in the on (e.g. first) position or the near field connection is active, the process proceeds to step 306.

In step 305, the headphones no longer receive the audio transmission as there is no connection to a corresponding audio transmission device. Any audio to be perceived will be provided by the now disconnected audio transmission device. The process then ends.

In step 306, the audio receiving device, for example, the headphones 14 (FIG. 2) receives any audio from the audio transmission device via receiver 146 (FIG. 2). The audio continues to be received by the headphones until either the connection with the local area network is lost, the near field communication link with the audio transmission device is lost or the entertainment system is powered down. By employing the system and functionality of the present invention, user will be able to enjoy music or other audio content without disturbing others that may be in a room or in close proximity to the user. Additionally, the device interconnection is automatic; the user does not have to register or manually interconnect the several devices, which provides for a more enjoyable user experience.

Although the description has been described with respect to particular embodiments thereof, these particular embodiments are merely illustrative, and not restrictive. For example, the audio transmission device may be implemented by any suitable device capable of providing or transmitting audio signals including, but not limited to, a personal computer, a laptop computer, a smart device, speakers or an audio bar. As mentioned above, the audio receiving device may be implemented by any suitable device of receiving audio signals including, but not limited to, wired, over-the-head and wireless speakers or headphones.

Any suitable programming language can be used to implement the routines of particular embodiments including C, C++, Java, assembly language, etc. Different programming techniques can be employed such as procedural or object oriented. The routines can execute on a single processing device or multiple processors. Although the steps, operations, or computations may be presented in a specific order, this order may be changed in different particular embodiments. In some particular embodiments, multiple steps shown as sequential in this specification can be performed at the same time.

Particular embodiments may be implemented in a computer-readable storage medium for use by or in connection with the instruction execution system, apparatus, system, or device. Particular embodiments can be implemented in the form of control logic in software or hardware or a combination of both. The control logic, when executed by one or more processors, may be operable to perform that which is described in particular embodiments.

Particular embodiments may be implemented by using a programmed general purpose digital computer, by using application specific integrated circuits, programmable logic devices, field programmable gate arrays, optical, chemical, biological, quantum or nanoengineered systems, components and mechanisms may be used. In general, the functions of particular embodiments can be achieved by any means as is known in the art. Distributed, networked systems, components, and/or circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope to implement a program or code that can be stored in a machine-readable medium to permit a computer to perform any of the methods described above.

A "processor" includes any suitable hardware and/or software system, mechanism or component that processes data, signals or other information. A processor can include a system with a general-purpose central processing unit, multiple processing units, dedicated circuitry for achieving functionality, or other systems. Processing need not be limited to a geographic location, or have temporal limitations. For example, a processor can perform its functions in "real time," "offline," in a "batch mode," etc. Portions of processing can be performed at different times and at different locations, by different (or the same) processing systems. Examples of processing systems can include servers, clients, end user devices, routers, switches, networked storage, etc. A computer may be any processor in communication with a memory. The memory may be any suitable processor-readable storage medium, such as random-access memory (RAM), read-only memory (ROM), magnetic or optical disk, or other non-transitory media suitable for storing instructions for execution by the processor.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

We claim:

1. An entertainment system comprising:

in a first room, a first audio transmission device comprising audio content, an audio controller and a first audio speaker;

in a second room, a second audio transmission device comprising a second audio speaker;

an audio receiving device including a sensor module having a sensor switch;

a first network hub providing connectivity between the first audio transmission device and the audio receiving device in a first room; and a second network hub providing connectivity between the second audio transmission device and the audio receiving device in a second room;

wherein, in an initial state, the audio controller connects first audio signals corresponding to the audio content to the first audio speaker;

wherein, when the sensor switch is in a first position:

if the audio receiving device is in the first room, the audio controller disconnects the first audio signals from the first audio speaker and wirelessly connects the first audio signals to the audio receiving device instead, via the first network hub; and if the audio receiving device is in the second room, transmission of the first audio signals to the audio receiving device is terminated, and second audio signals are transmitted from the second audio transmission device to the audio receiving device via the second network hub; and wherein, when the sensor switch is in a second position, the audio controller disconnects the first audio signals from the audio receiving device.

2. The entertainment system of claim 1, further including a plurality of audio receiving devices, each of the plurality being configured to couple to either one of the first and second network hubs.

3. The entertainment system of claim 1, wherein the first audio transmission device is a television set.

4. The entertainment system of claim 1, wherein the first audio transmission device is a computing device.

5. The entertainment system of claim 1, wherein the audio receiving device is an ear bud.

6. The entertainment system of claim 1, wherein the audio receiving device is an over the ear headphone.

7. The entertainment system of claim 1, wherein when the second audio transmission device senses the audio receiving device the second audio transmission device transmits the audio signals to the audio receiving device.

8. The entertainment system of claim 1, wherein at least one of the first and second network hubs is a Bluetooth connection.

9. The entertainment system of claim 1, wherein at least one of the first and second network hubs is an 802.11n connection.

10. The entertainment system of claim 8, wherein when the first audio transmission device is connected to the second network hub coupled to the second audio transmission device, the audio receiving device is automatically paired with the first audio transmission device.

11. A method, comprising:

automatically connecting an audio receiver to a first audio transmission device in a first room, the first audio transmission device comprising a first audio speaker;

in an initial state, automatically connecting audio signals in the first audio transmission device to the first audio speaker; and subsequent to the initial state, automatically responding to a position of a switch such that, when the switch is translated to a first position if the audio receiving device is in the first room, the first audio signals are disconnected from the first audio speaker and wirelessly received by the audio receiver via a first network hub; and if the audio receiving device is in a second room, transmission of the first audio signals to the audio receiving device is terminated, and second audio signals are transmitted from a second audio transmission device in the second room to the audio receiving device via a second network hub; and when the switch is-translated to a second position, wireless reception of the first audio signals from the audio transmission device is discontinued.

12. The method of claim 11, wherein the first audio transmission device is connected to a network; and wherein automatically connecting the audio receiver to the first audio transmission device includes connecting the audio receiver to the network.

13. The method of claim 11, further comprising:

when the second audio transmission device senses the audio receiving device, transmitting audio signals from the second audio transmission device to the audio receiving device.

14. The method of claim 11, wherein the wireless reception of audio signals by the audio receiving device comprises use of a Bluetooth connection.

15. The method of claim 11, wherein the wireless reception of audio signals by the audio receiving device comprises use of a near field connection device.

16. The method of claim 11, wherein the wireless reception of audio signals by the audio receiving device comprises use of an 802.11n connection.

* * * * *